US010573179B2

(12) United States Patent
Tu et al.

(10) Patent No.: US 10,573,179 B2
(45) Date of Patent: Feb. 25, 2020

(54) ILLUMINATING DEVICE, ILLUMINATING GUIDANCE SYSTEM AND ILLUMINATING GUIDANCE METHOD

(71) Applicants: LITE-ON ELECTRONICS (GUANGZHOU) LIMITED, Guangzhou (CN); Lite-On Technology Corporation, Taipei (TW)

(72) Inventors: Chin-Jui Tu, Taipei (TW); Chien-Lung Wang, Taipei (TW); Ming-Hung Chien, Taipei (TW)

(73) Assignees: LITE-ON ELECTRONICS (GUANGZHOU) LIMITED, Guangzhou (CN); Lite-On Technology Corporation, Taipei (TW)

( * ) Notice: Subject to any disclaimer, the term of this patent is extended or adjusted under 35 U.S.C. 154(b) by 0 days.

(21) Appl. No.: 16/161,066

(22) Filed: Oct. 16, 2018

(65) Prior Publication Data

US 2019/0325749 A1 Oct. 24, 2019

(30) Foreign Application Priority Data

Apr. 23, 2018 (CN) ..... 2018 1 0367941

(51) Int. Cl.
*G08G 1/14* (2006.01)
*G08B 5/36* (2006.01)

(52) U.S. Cl.
CPC ..... *G08G 1/142* (2013.01); *G08B 5/36* (2013.01)

(58) Field of Classification Search
CPC ..... G08B 1/142
USPC ..... 340/932.2, 942, 955, 958, 995.1, 525, 340/539.1; 382/103, 107, 209
See application file for complete search history.

(56) References Cited

U.S. PATENT DOCUMENTS 5,432,508 A * 7/1995 Jackson ..... E04H 6/42 340/932.2
6,107,942 A * 8/2000 Yoo ..... G08G 1/14 340/468
6,771,185 B1 * 8/2004 Yoo ..... G06Q 30/0284 340/525
6,917,307 B2 * 7/2005 Li ..... G08G 1/14 194/902
9,286,804 B2 * 3/2016 Fayfield ..... G08G 1/142
2001/0022564 A1 * 9/2001 Youngquist ..... G09F 9/33 345/55
2018/0114438 A1 * 4/2018 Rajagopalan ..... G08G 1/015

* cited by examiner

*Primary Examiner* — Tai T Nguyen
(74) *Attorney, Agent, or Firm* — JCIPRENT

(57) ABSTRACT

An illuminating device, an illuminating guidance system and an illuminating guidance method are provided. The method includes: detecting a vehicle entering a parking lot to generate vehicle entrance information by a detector; detecting at least one vacant parking space of the parking lot to generate vacant parking space information by a sensor; receiving the vehicle entrance information and the vacant parking space information to plan a guidance path by a controller; and controlling the LED light board to provide a guidance light pattern by the controller, thereby guiding the vehicle to the vacant parking space according to the guidance light pattern.

12 Claims, 11 Drawing Sheets

ILLUMINATING DEVICE, ILLUMINATING GUIDANCE SYSTEM AND ILLUMINATING GUIDANCE METHOD

CROSS-REFERENCE TO RELATED APPLICATION

This application claims the priority benefit of China application serial no. 201810367941.7, filed on Apr. 23, 2018. The entirety of the above-mentioned patent application is hereby incorporated by reference herein and made a part of this specification.

BACKGROUND

Field of the Invention

The invention relates to a guidance system and an illuminating guidance method and more particularly to an illuminating device, an illuminating guidance system and a method thereof for guiding a vehicle.

Description of Related Art

Along with the development of detection techniques, many indoor parking garages detect the status of the parking spaces by means of ultrasonic detection method. However, in order to correctly detect the status of each parking space inside an indoor parking garage, it is required to install an ultrasonic sensor above each parking space, for example, by installing each ultrasonic sensor on a ceiling, which accordingly increases the construction cost of the detection system for the parking space. Moreover, since an outdoor parking lot is deployed with no ceiling, it is difficult to install the ultrasonic sensors in the outdoor parking lot.

Therefore, it is necessary to provide a guidance system suitable for parking space guidance in the outdoor parking lot to reduce drivers' time for searching parking spaces.

SUMMARY

The invention provides an illuminating device, an illuminating guidance system and an illuminating guidance method capable of guiding a vehicle in an indoor parking garage or an outdoor parking lot, thereby reducing a driver's time for searching a parking space.

An illuminating device for guiding a vehicle in a parking lot is provided. The illuminating device includes a detector, a sensor, a LED light board and a controller. The detector is configured to detect the vehicle entering the parking lot to generate a vehicle entrance information. The sensor is configured to detect at least one vacant parking space of the parking lot to generate a vacant parking space information. The LED light board has a plurality of light emitting diodes arranged in an array. Each of the plurality of light emitting diodes provided with a guidance light or an illumination light, wherein the guidance light and illumination light have different luminance intensity values. The controller is coupled to the detector, the sensor and the LED light board. The controller receives the vehicle entrance information and plans a guidance path according to the vacant parking space information. The controller controls the LED light board to provide a guidance light pattern according to the guidance path, wherein the guidance light pattern is at least formed by the guidance light emitted from the plurality of light emitting diodes and the vehicle is guided to the vacant parking space according to the guidance light pattern.

An illuminating guidance system suitable for guiding a vehicle in a parking lot is provided. The illuminating guidance system includes a first illuminating device and a second illuminating device. The first illuminating device includes a detector, a sensor, a first LED light board and a controller. The controller is coupled to the detector, the sensor and the first LED light board. The detector is configured to detect the vehicle entering the parking lot to generate a vehicle entrance information. The sensor is configured to detect at least one vacant parking space of the parking lot to generate a vacant parking space information. The first LED light board has a plurality of first light emitting diodes arranged in an array. Each of the plurality of first light emitting diodes being provided with a guidance light or an illumination light, and the guidance light and illumination light have different luminance intensity values. The controller is configured to receive the vehicle entrance information and plan a guidance path according to the vacant parking space information. The controller controls the first LED light board to provide a guidance light pattern according to the guidance path. The guidance light pattern is at least formed by the guidance light emitted from the plurality of first light emitting diodes. The vehicle is guided to the vacant parking space according to the guidance light pattern. In addition, the second illuminating device includes a second LED light board. The second illuminating device and the first illuminating device communicate with each other through a wireless protocol.

An illuminating guidance method suitable for a parking lot is provided. The method includes steps of: detecting a vehicle entering a parking lot to generate vehicle entrance information by a detector; detecting at least one vacant parking space of the parking lot to generate vacant parking space information by a sensor; receiving the vehicle entrance information and the vacant parking space information and planning a guidance path according to the vehicle entrance information and the vacant parking space information by a controller; and controlling the LED light board to provide a guiding light pattern by the controller, thereby guiding the vehicle to the vacant parking space according to the guidance light pattern.

To sum up, in the embodiments of the invention, the illuminating guidance system guides the vehicle to the vacant parking space through the illuminating devices. As the illuminating devices are usually disposed in the indoor parking garage or the outdoor parking lot, the illuminating device for guiding the vehicle can reduce the construction cost of the parking space guidance system, and decrease the searching time that the driver is searching a vacant parking space in the indoor parking garage or the outdoor parking lot.

To make the above features and advantages of the invention more comprehensible, embodiments accompanied with drawings are described in detail below.

DESCRIPTION OF EMBODIMENTS

Figure 1:
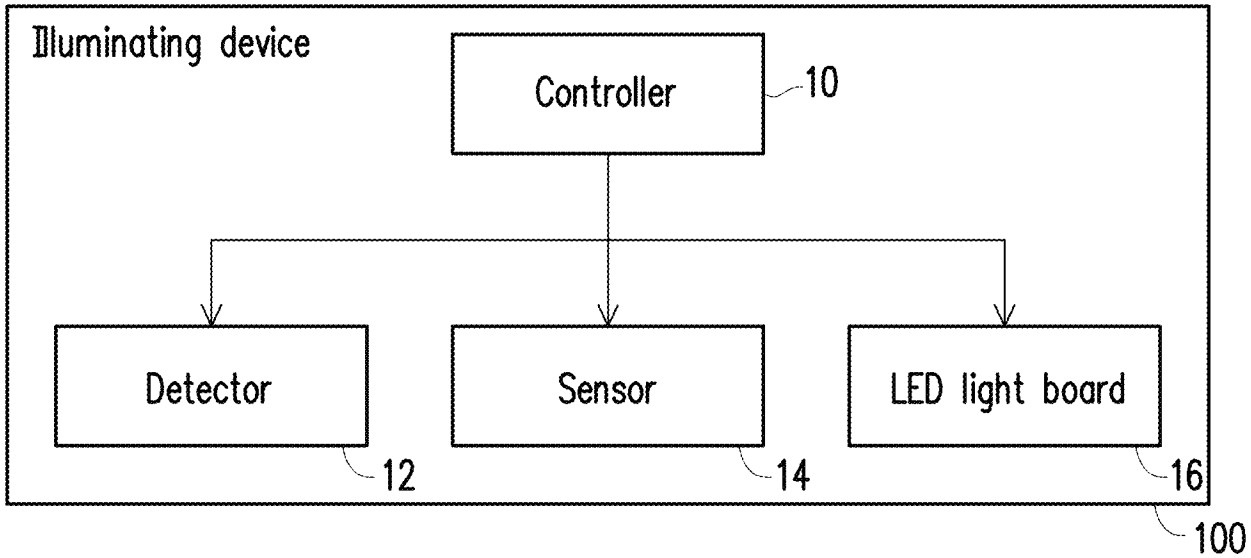
FIG. 1 is a schematic diagram illustrating an illuminating device with a guiding function according to an embodiment of the invention.

Both the foregoing and other technical descriptions, features and advantages of the invention are intended to be described more comprehensively by providing an embodiment accompanied with drawings hereinafter. The term "couple (or connect)" herein (including the claims) are refer to any direct and indirect connection means. For example, if the disclosure describes a first apparatus being coupled (or connected) to a second apparatus, then it should be interpreted that the first apparatus can be directly connected to the second apparatus, or the first apparatus can be indirectly connected to the second apparatus through other devices or by a certain coupling means. Moreover, elements/components/steps with same reference numerals represent same or similar parts in the drawings and embodiments. Elements/components/notations with the same reference numerals in different embodiments may be referenced to the related description.

FIG. 1 is a schematic diagram illustrating an illuminating device with a guiding function according to an embodiment of the invention.

Referring to FIG. 1, an illuminating device 100 with a guiding function includes a controller 10, a detector 12, a sensor 14, and a LED light board 16. The detector 12, the sensor 14 and the LED light board 16 are coupled to the controller 10. The illuminating device 100 may be disposed in, for example, a parking lot.

The controller 10 may be a central processing unit (CPU) or any other programmable microprocessor for general or special use, a digital signal processor (DSP), a programmable controller, an application specific integrated circuit (ASIC), a micro controller unit (MCU), other similar devices, or a combination of these devices.

The detector 14 may be a charge-coupled devices (CCD) camera, a complementary metal-oxide-semiconductor (CMOS) camera or a video camera or an infrared camera.

The sensor 14 may be one of or a combination of an ultrasonic sensor, an image sensor and an infrared sensor.

Figure 2B:
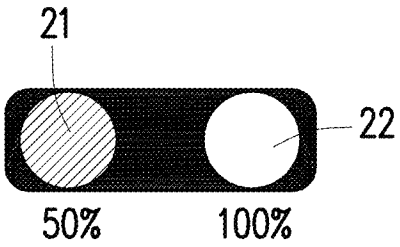
FIG. 2B is a schematic diagram illustrating the light emitted diodes providing different luminance intensity values according to an embodiment of the invention.
Figure 2A:
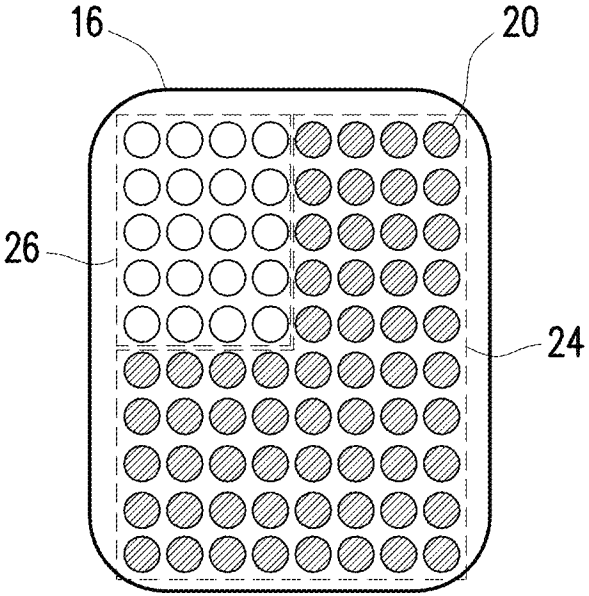
FIG. 2A is a schematic diagram illustrating the LED light board having a plurality of light-emitted diodes according to an embodiment of the invention.

The LED light board 16 includes a plurality of light-emitted diodes (LEDs). For example, FIG. 2A is a schematic diagram illustrating the LED light board having light-emitted diodes 20 according to an embodiment of the invention. Referring to FIG. 2A, the LED light board 16 includes a plurality of light emitting diodes 20 arranged in an array. In addition, each of the light emitted diodes 20 may provide different luminance intensity values. FIG. 2B is a schematic diagram illustrating the light emitted diodes 20 providing different luminance intensity values according to an embodiment of the invention. Referring to FIG. 2B, for example, when the light emitted by the light emitting diodes 20 has the luminance intensity value of 50%, it may be used for general illumination. The light used for the general illumination may also be referred to as "an illumination light 21". Additionally, when the light emitted by the light emitting diodes 20 has the luminance intensity value of 100%, it may be used for vehicle guidance. The light used for the vehicle guidance may also be referred to as "a guidance light 22". However, the luminance intensity values of both the illumination light 21 and the guidance light 22 are not limited in the invention. In other words, the luminance intensity value of the guidance light 22 is greater than the luminance intensity value of the illumination light 21, for example. Specially, in the present exemplary embodiment, different groups of light emitting diodes 20 of the LED light board 16 may emit light with difference luminance intensity values. For example, illustrated in FIG. 2A, a group of light emitting diodes 24 of the LED light board 16 may emit the illumination light 21 to generate an illumination light pattern. In other words, the illumination light pattern is a collection of the illumination light emitted from a group of the light emitting diodes 24 of the LED light board 16. In the meantime, another group 26 of the light emitting diodes of the LED light board 16 may emit the guidance light 22 to generate a guidance light pattern. In other words, the guidance light pattern is a collection of the guidance light emitted from another group of the light emitting diodes 26 of the LED light board 16. Thus, when the LED light board 16 simultaneously emits the illumination light 21 and the guidance light 22, an illuminating guidance light pattern consisting of the illumination light pattern and the guidance light pattern may be generated.

It should be noted that the LED light board 16 is formed of a dot-matrix display as shown in FIG. 2A the guidance light pattern is performed by the dot-matrix display.

It should be noted that one light-emitting device 100 may have at least one LED light board 16. Here, the light-emitting device 100 having one LED light board 16 is taken as an example for description.

FIG. 3A to FIG. 3F are schematic diagrams illustrating vehicle guidance by using the illuminating device having a LED light board according to an embodiment of the invention.

Figure 3B:
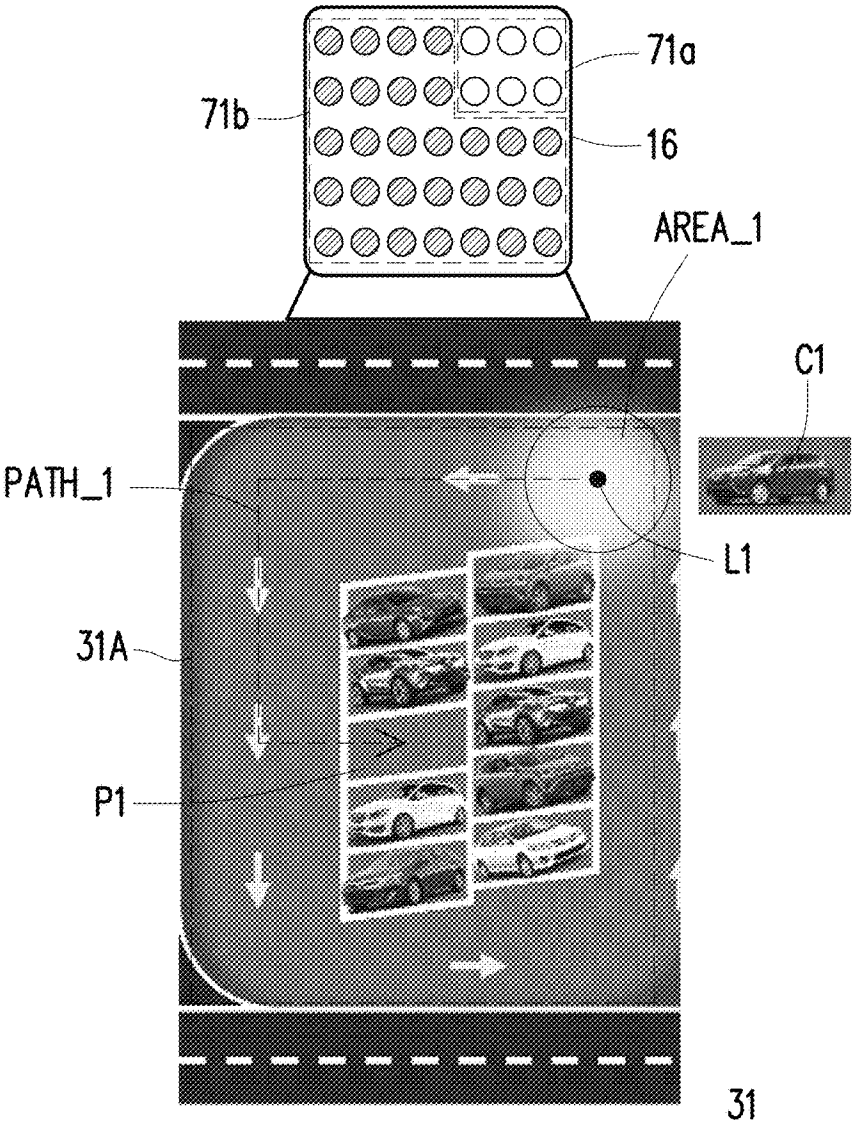
FIG. 3A to FIG. 3F are schematic diagrams illustrating vehicle guidance by using the illuminating device having a LED light board according to an embodiment of the invention.
Figure 3A:
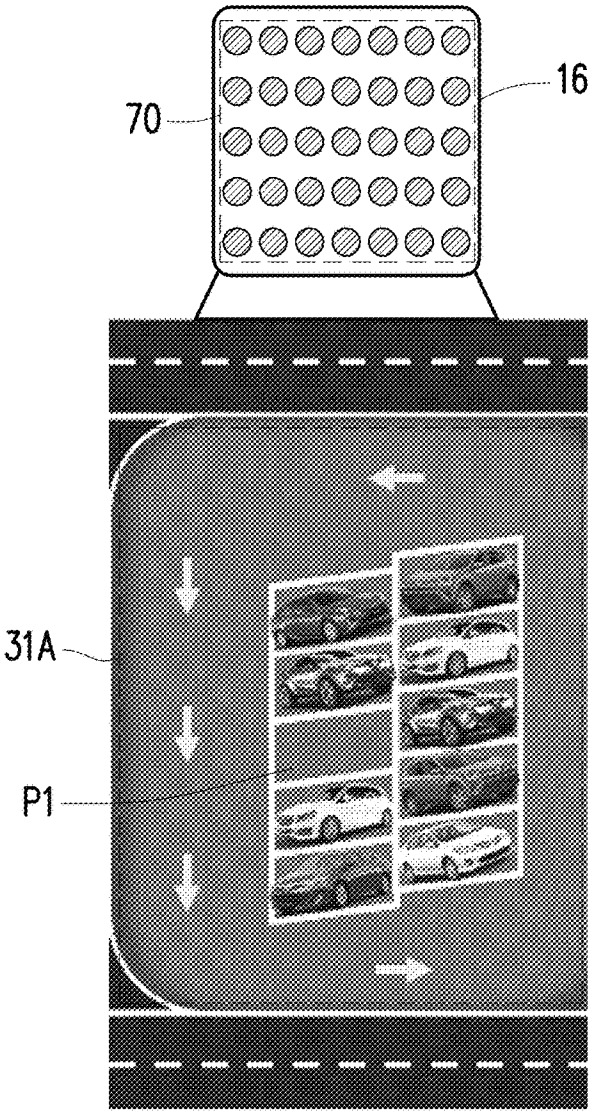

Referring to FIG. 3A, it is assumed that illuminating device 100 is disposed in a parking lot 31. When the sensor 14 of the illuminating device 100 does not detect any vehicle entering the parking lot 31, the controller 10 of the illuminating device 100 controls all the light emitting diodes 20 in the LED light board 16 to provide the illumination light 21 to form an illumination light pattern 70, as illustrated in FIG. 3A. When the LED light board 16 projects the light of the illumination light pattern 70 from the top to the ground of the parking lot 31, an illumination area 31A is generated in the parking lot 31.

Then, referring to FIG. 3B, when the detector 12 of the illuminating device 100 detects a vehicle C1 entering the parking lot 31, the detector 12 of the illuminating device 100 may generate vehicle entrance information. In the present exemplary embodiment, the vehicle entrance information is, for example, an image of the vehicle C1, but the invention is not limit to any type of the vehicle entrance information. In addition, the sensor 14 of the illuminating device 100 may be configured to detect at least one vacant parking space P1 of the parking lot 31 to generate the vacant parking space information. In the present exemplary embodiment, the illuminating device 100 may detect the vacant parking space in the parking lot 31 by means of ultrasonic waves or infrared light so as to obtain the location information of the vacant parking space P1 as illustrated in FIG. 3B. The location information of the vacant parking space P1 is the aforementioned vacant parking space information.

Then, the controller 10 of the illuminating device 100 may receive the aforementioned vehicle entrance information and plan a guidance path PATH_1 illustrated in FIG. 3B according to the aforementioned vacant parking space information related to the vacant parking space P1.

Specifically, referring to FIG. 3B, if it is assumed that the controller 10 of the illuminating device 100 receives the vehicle entrance information and plans the guidance path PATH _1 according to the vacant parking space information related to the vacant parking space P1, the detector 12 detects that the vehicle C1 approaches a location L1 of an area AREA_1 on the guidance path PATH_1 in the parking lot 31, the controller 10 of the illuminating device 100 may control a group of the light emitting diodes in the LED light board 16 of the illuminating device 100 to emit the guidance light 22 so as to generate a guidance light pattern 71*a*. The controller 10 of the illuminating device 100 may control another group of the light emitting diodes in the LED light board 16 of the illuminating device 100 to emit the illumination light 21 so as to generate an illumination light pattern 71*b*. An illuminating guidance light pattern consisting of the guidance light pattern 71*a* and the illumination light pattern 71*b* projected on the ground of the parking lot 31 is provided for guiding the vehicle C1 to the vacant parking space P1. In other words, the illuminating guidance light pattern has the guidance light pattern 71*a* with higher luminance intensity value and the illumination light pattern 71*b* with lower luminance intensity value. When the illuminating guidance light pattern consisting of the guidance light pattern 71*a* and the illumination light pattern 71*b* is projected on the ground of the parking lot 31, the guidance light pattern 71*a* projected on the location of the area AREA_1 may have higher luminance intensity value, and thus, the vehicle driver may explicitly know a guiding direction to the vacant parking space P1. The vehicle driver may obtain the guiding direction to the vacant parking space P1 according to the guidance light pattern 71*a* with higher luminance intensity value projected on the location L1 of the area AREA_1.

Then, when the detector 12 detects that the vehicle C1 reaches and is located at the location L1 of the area AREA_1, the illuminating device 100 may project the parking lot 31 with the illuminating guidance light pattern consisting of the guidance light pattern 71*a* and the illumination light pattern 71*b*, such that the guidance light pattern 71*a* projected on the location L1 of the area AREA_1 may have higher luminance intensity value. Thereafter, referring to FIG. 3B to FIG. 3C simultaneously, when the detector 12 detects that the vehicle C1 is leaving the location L1 of the area AREA_1, the controller 10 may switch the group of the light emitting diodes in the LED light board 16 illustrated in FIG. 3B, which is originally configured for generating the guidance light pattern 71*a*, to emit the illumination light 21.

Figure 3D:
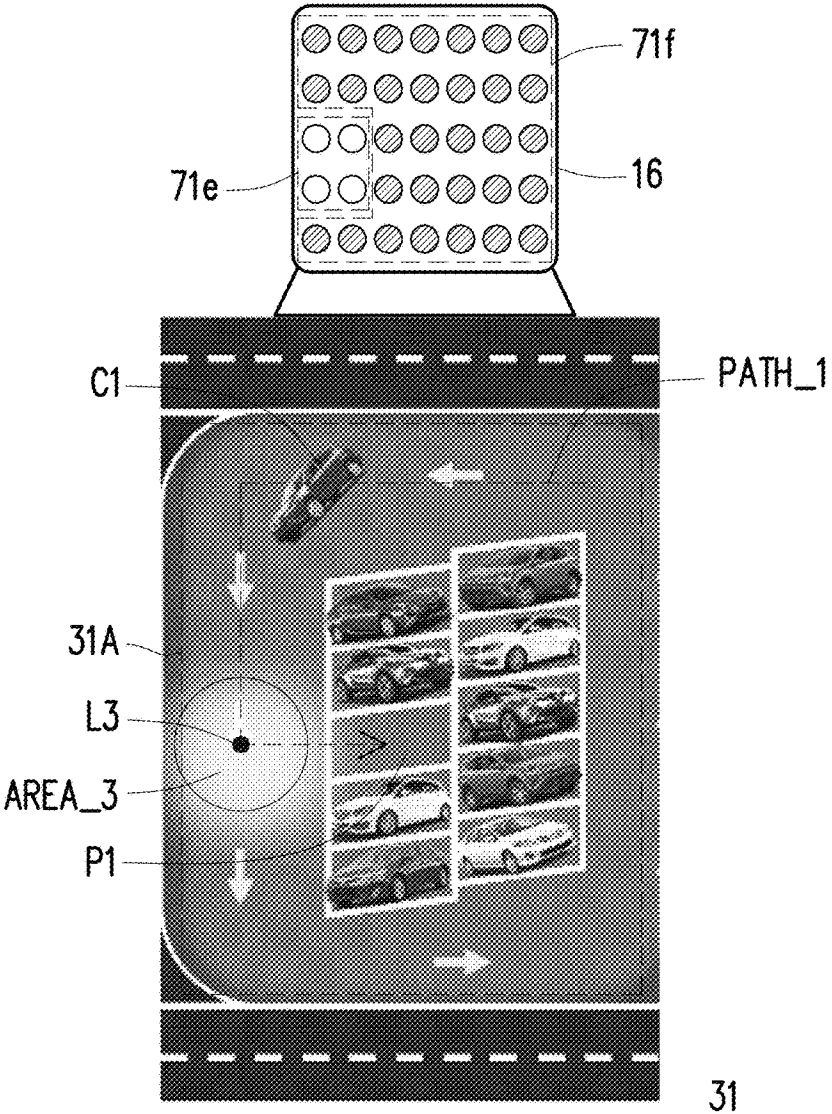
Figure 3C:
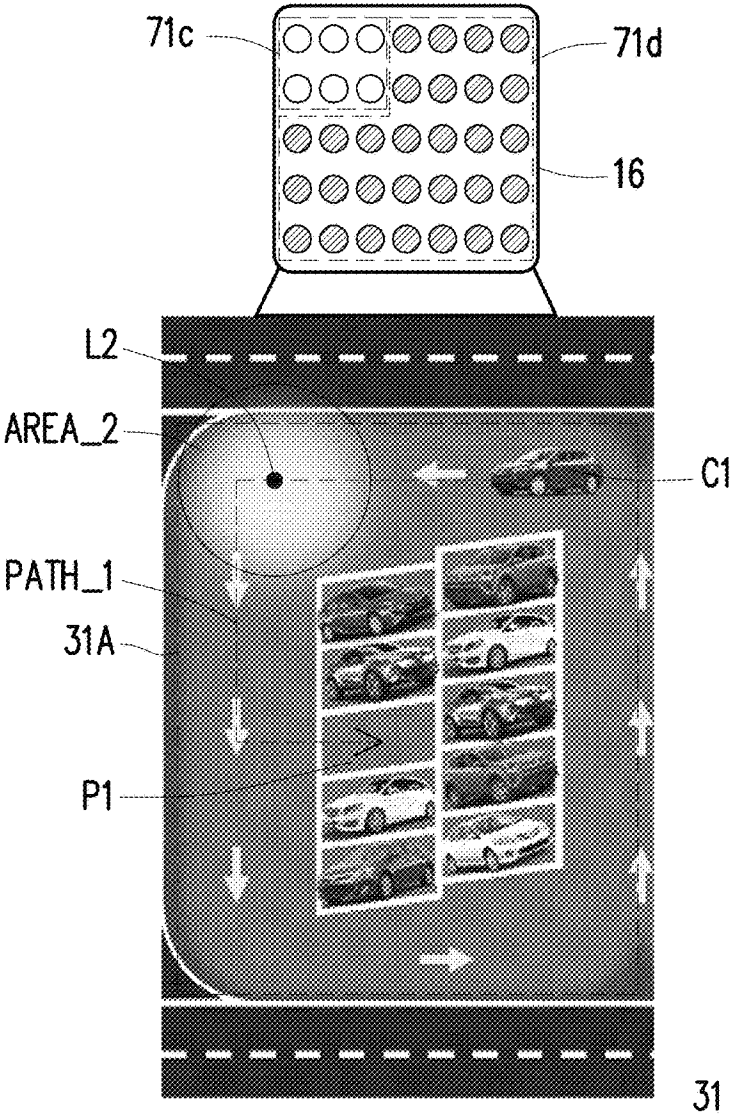

Then, when the detector 12 detects that the vehicle C1 is leaving the location L1 of the area AREA_1 and approaches a location L2 of an area AREA_2 on the guidance path PATH_1, as illustrated in FIG. 3C, the controller 10 of the illuminating device 100 may control a group of light emitting diodes in the LED light board 16 of the illuminating device 100 to emit the guidance light 22 so as to generate a guidance light pattern 71*c*. The controller 10 of the illuminating device 100 may control another group of the light emitting diodes in the LED light board 16 of the illuminating device 100 to emit the illumination light 21 to generate an illumination light pattern 71*d*. An illuminating guidance light pattern consisting of the guidance light pattern 71*c* and the illumination light pattern 71*d* is projected to the ground of the parking lot 31 to guide the vehicle C1 to the vacant parking space P1. When the parking lot 31 is projected by the illuminating guidance light pattern consisting of the guidance light pattern 71*c* and the illumination light pattern 71*d*, the guidance light pattern 71*c* projected on the location L2 of the area AREA_2 may have higher luminance intensity value, and thus, the vehicle driver may explicitly know the guiding direction toward to the vacant parking space P1. In other words, the vehicle C1 may obtain the guiding direction toward to the vacant parking space P1 according to the guidance light pattern 71*c* with higher luminance intensity value.

Then, when the vehicle C1 reaches and is located at the location L2 of the area AREA_2, the illuminating device 100 may project the parking lot 31 by using the illuminating guidance light pattern consisting of the guidance light pattern 71*c* and the illumination light pattern 71*d*, such that the guidance light pattern 71*c* having higher luminance intensity value is projected on the location L2 of the area AREA_2. Then, referring to FIG. 3C and FIG. 3D, when the vehicle C1 is leaving the location L2 of the area AREA_2 toward to the vacant parking space P1, the controller 10 may switch the guidance light 22 of the guidance light pattern 71*c* to emit the illumination light 21.

Then, when the detector 12 detects that the vehicle C1 is leaving from the location L2 of the area AREA_2 and approaches a location L3 of an area AREA _3 on the guidance path PATH_1, as illustrated in FIG. 3D, the controller 10 of the illuminating device 100 may control a group of the light emitting diodes in the LED light board 16 of the illuminating device 100 to emit the guidance light 22 to generate a guidance light pattern 71*e*. The controller 10 of the illuminating device 100 may also control another group of the light emitting diodes in the LED light board 16 of the illuminating device 100 to emit the illumination light 21 to generate an illumination light pattern 71*f*. In this circumstance, the illuminating device 100 may irradiate the parking lot 31 by using an illuminating guidance light pattern consisting of the guidance light pattern 71*e* and the illumination light pattern 71*f* to guide the vehicle C1 to the vacant parking space P1. When the parking lot 31 is projected by the illuminating guidance light pattern consisting of the guidance light pattern 71*e* and the illumination light pattern 71*f*, the guidance light pattern 71*e* projected on the location L3 of the area AREA_3 may have higher luminance intensity value, and thus, the vehicle driver may explicitly know the guiding direction to the vacant parking space P1. The vehicle Cl may obtain the guiding direction toward the vacant parking space P1 according to the guidance light pattern 71*e* with higher luminance intensity value projected on the location 3 of the area AREA_3.

Then, when the vehicle C1 reaches and is located at the location L3 of the area AREA_3, the illuminating guidance light pattern consisting of the guidance light pattern 71*e* and the illumination light pattern 71*f* is projected to the ground of the parking lot 31, such that the guidance light pattern 71*e* having higher luminance intensity value is projected on the location L3 of the area AREA_3. Then, referring to FIG. 3D and FIG. 3E, when the vehicle C1 is leaving from the location L3 of the area AREA_3, the controller 10 may switch the group of the light emitting diodes in the LED light board to emit the illumination light instead of the guidance light of the guidance light pattern 71*e*.

Figure 3F:
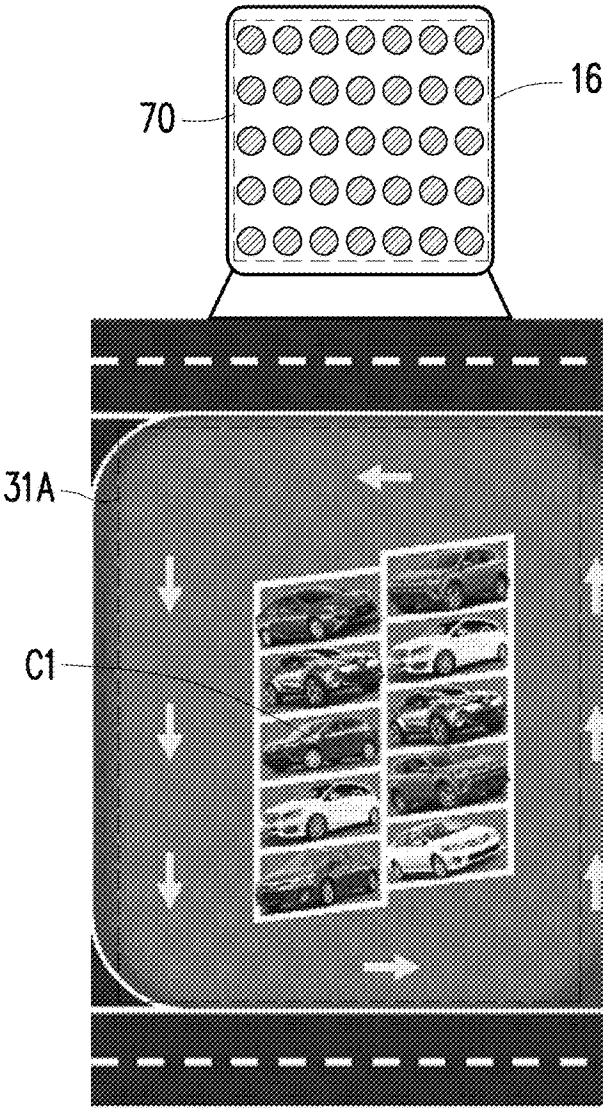
Figure 3E:
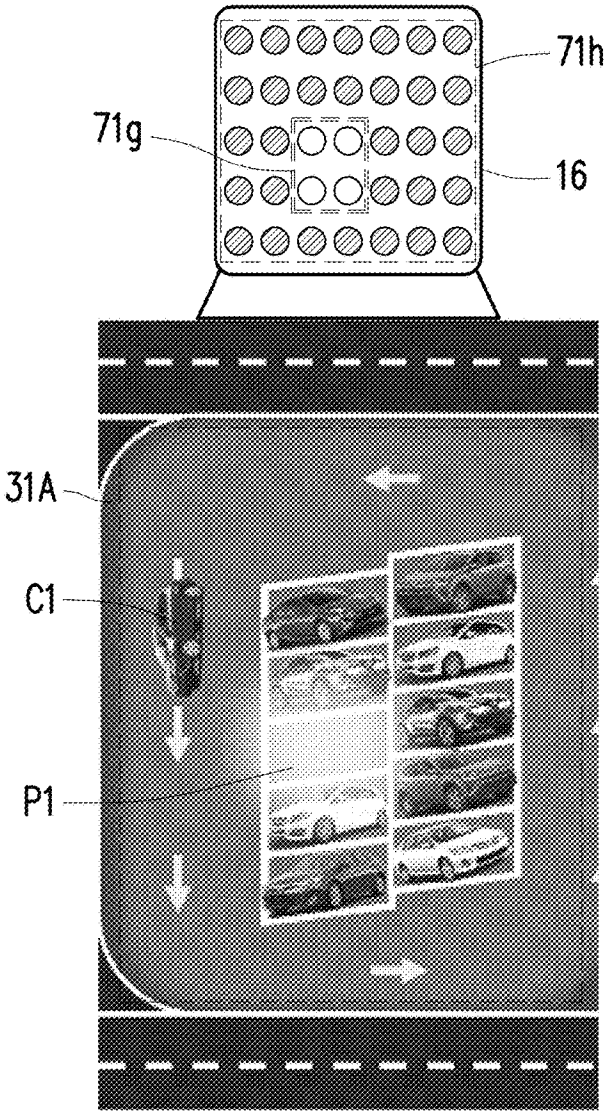

Then, when the detector 12 detects that the vehicle C1 is leaving from the location L3 of the area AREA _3 and approaches the location of the vacant parking space P1 on the guidance path PATH_1, as illustrated in FIG. 3E. The controller 10 of the illuminating device 100 may control a group of the light emitting diodes in the LED light board 16 of the illuminating device 100 to emit the guidance light 22 so as to generate a guidance light pattern 71*g*. The controller 10 of the illuminating device 100 may control another group of the light emitting diodes in the LED light board 16 of the illuminating device 100 to emit the illumination light 21 so as to generate an illumination light pattern 71*h*. In this circumstance, an illuminating guidance light pattern consisting of the guidance light pattern 71*g* and the illumination light pattern 71*h* is provided for guiding the vehicle C1 to the vacant parking space P1. When the parking lot 31 is projected by the illuminating guidance light pattern consisting of the guidance light pattern 71*g* and the illumination light pattern 71*h*, the guidance light pattern 71*g* having higher luminance intensity value is projected on the location of the vacant parking space P1, and thus, the vehicle driver may explicitly know the guiding direction to the vacant parking space P1. The vehicle C1 may obtain the guiding direction to the vacant parking space P1 according to the guidance light pattern 71*g* of the illuminating guidance light pattern with higher luminance intensity value.

Then, referring to FIG. 3F, when the detector 12 detects that the vehicle C1 is entered into the vacant parking space P1, the controller 10 controls all the light emitting diodes 20 in the LED light board to emit the illumination light 21.

It should be noted that the illuminating device 100 is not limited to including one LED light board 16 and may include a plurality of LED light boards 16. For example, FIG. 4 is a schematic diagram illustrating vehicle guidance by using an illuminating device having two LED light boards according to one embodiment of the invention.

Figure 4:
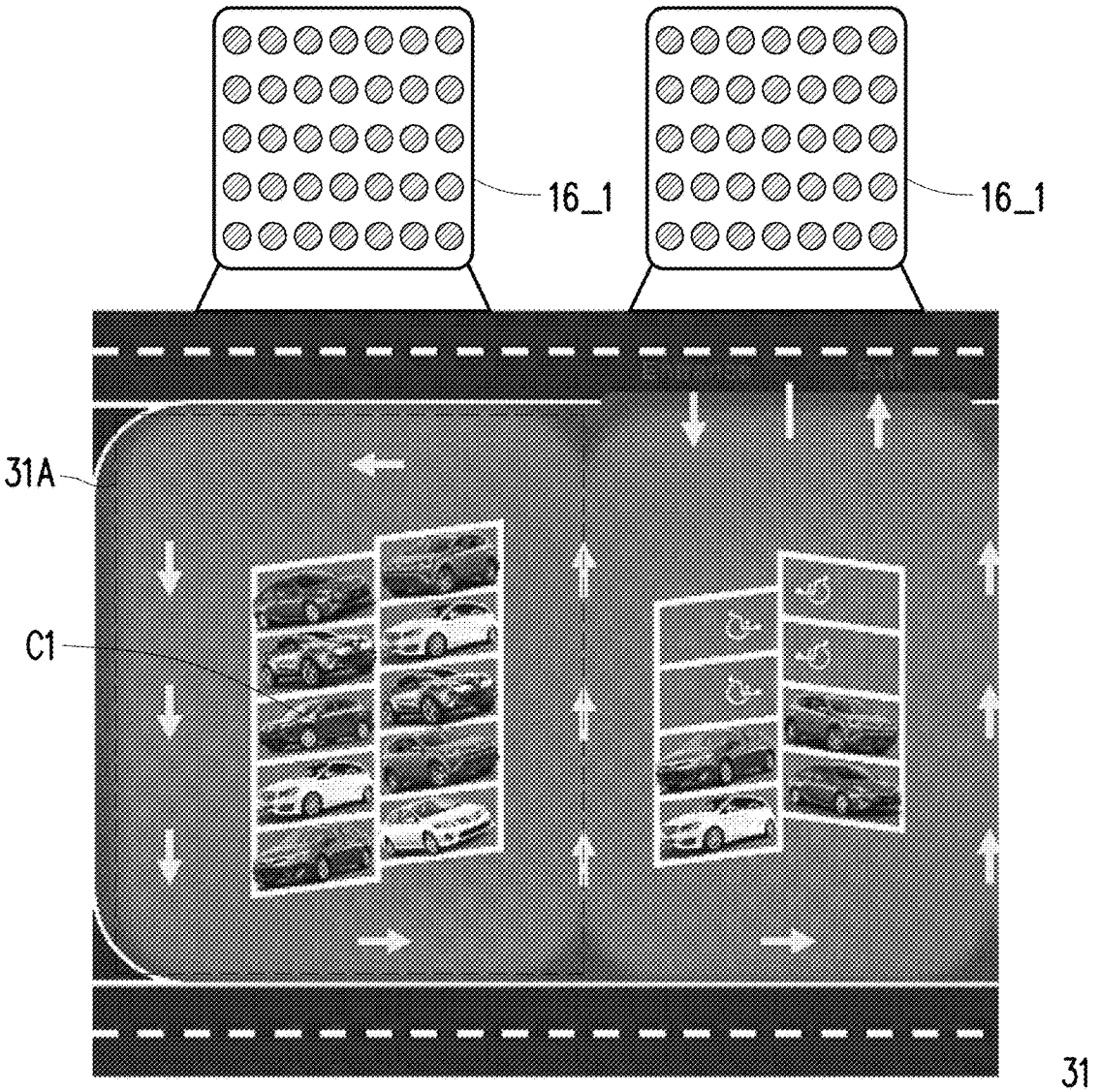
FIG. 4 is a schematic diagram illustrating vehicle guidance by using an illuminating device having two LED light boards according to an embodiment of the invention.

Referring to FIG. 4, as illustrated in FIG. 4, the illuminating device 100 includes a LED light board 16_1 and a LED light board 16_2, the controller 10 may control the LED light board 16_1 and the LED light board 16_2 to jointly generate the guidance light pattern as illustrated in FIG. 3A to FIG. 3F, and thus, the vehicle C1 may be guided to the vacant parking space according to the guidance light pattern. However, the number of the LED light boards in the illuminating device 100 is not limited in the invention.

Figure 5:
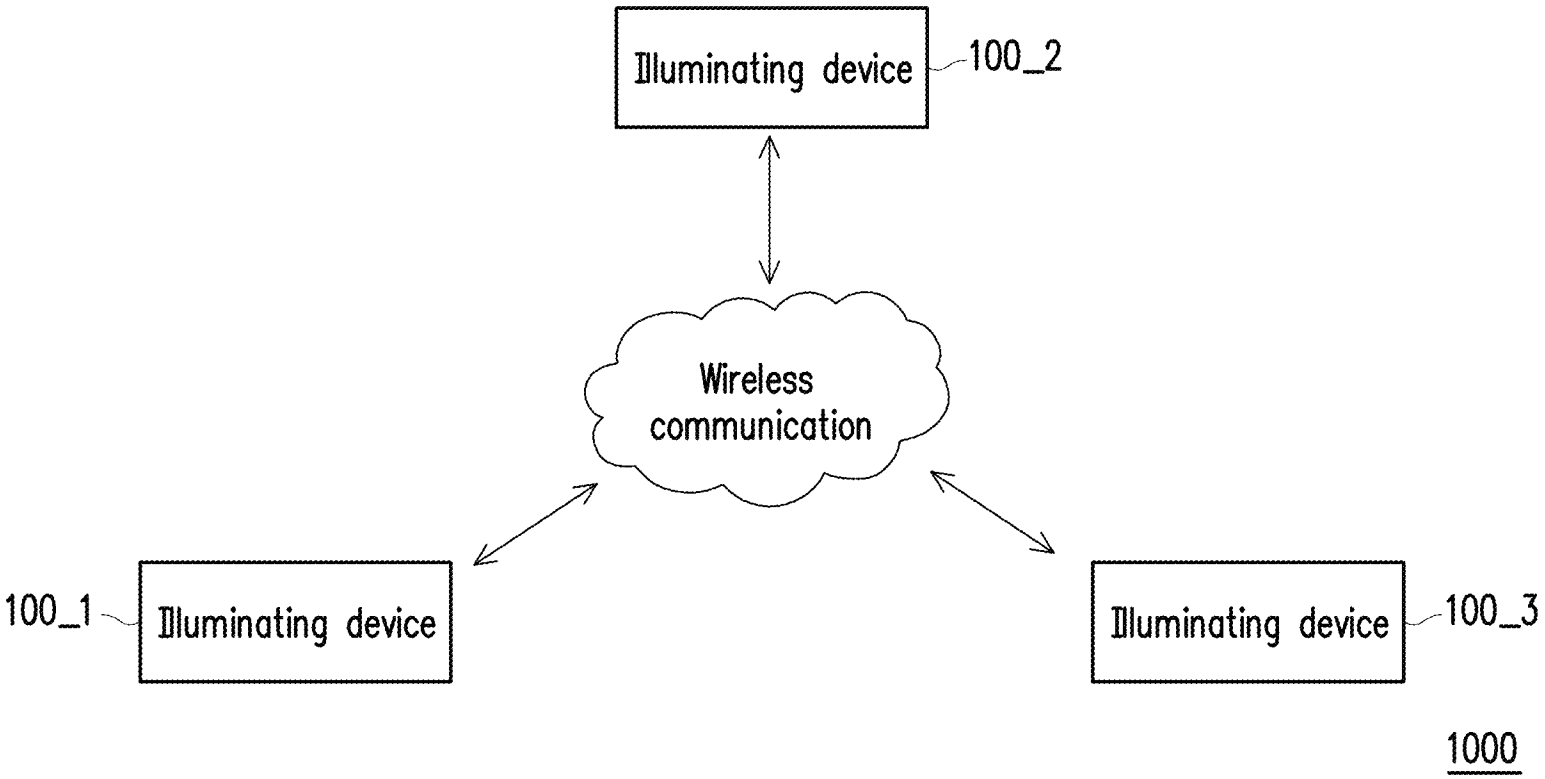
FIG. 5 is a schematic diagram illustrating an illuminating guidance system disposed with a plurality of illuminating devices according to an embodiment of the invention.

In an embodiment, a plurality of illuminating devices 100 as illustrated in FIG. 1 may also be disposed in a parking lot. For example, FIG. 5 is a schematic diagram illustrating an illuminating guidance system disposed with a plurality of illuminating devices according to one embodiment of the invention. Referring to FIG. 5, an illuminating device 1000 may be disposed in a parking lot. The illuminating guidance system 1000, for example, may include an illuminating device 100_1, an illuminating device 100 2 and an illuminating device 100_3. The illuminating device 100_1, the illuminating device 1002 and the illuminating device 100_3 may transmit data or signals to one another through a wireless protocol. The illuminating device 100_1, the illuminating device 1002 and the illuminating device 100_3 respectively include the similar elements and provides the same function of the illuminating device 100 illustrated in FIG. 1 and thus, will not be repeatedly described. Additionally, each of the illuminating device 100_1, the illuminating device 100_2 and the illuminating device 100_3 includes at least one LED light board to provide the guidance light 22 and/or the illumination light 21. It should be noted that the number of the illuminating devices disposed in the illuminating guidance system 1000 is not limited in the invention. In other words, the illuminating guidance system 1000 may also include only the illuminating device 100_1 and the illuminating device 100_2 and is not limited to include the three illuminating devices 100_1, 100_2 and 100_3 as illustrated in FIG. 5.

In an embodiment, a transmission protocol used by communication circuits of the illuminating devices 100_1 to 100_3 may include a ZigBee protocol, a long range (LoRa) protocol or a narrow band Internet of Thing (NB-IoT) protocol. The communication circuits of the illuminating devices 100_1 to 100_3 may communicate with one another through a wireless signal (e.g., a ZigBee, a LoRa or an NB-IoT signal).

Figure 6A:
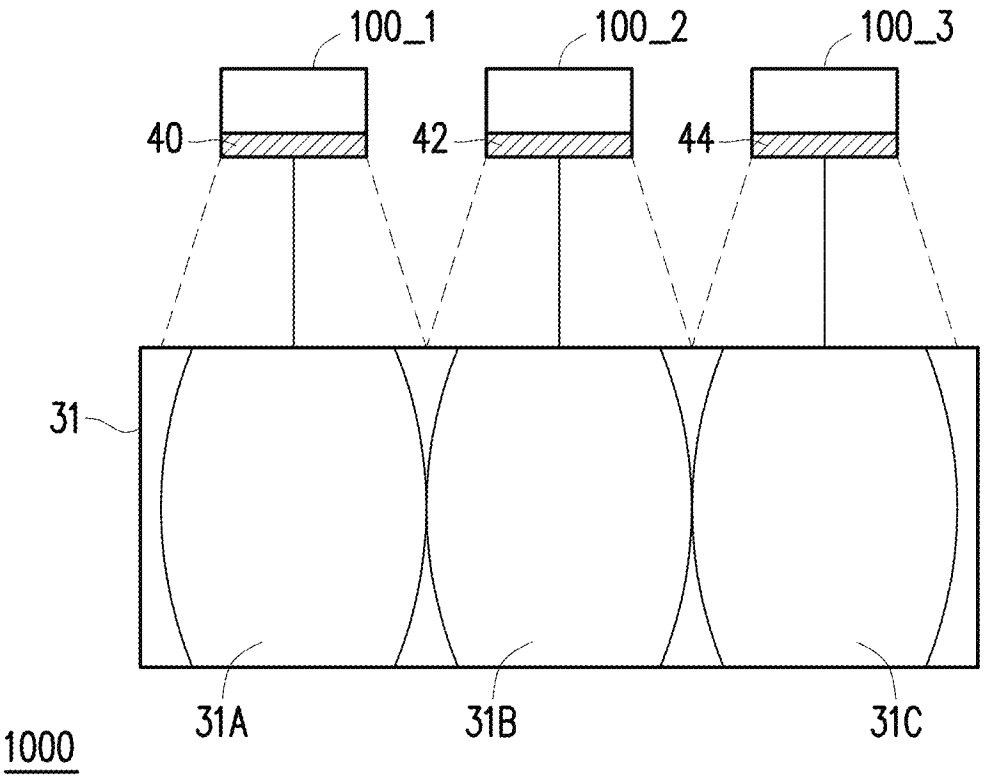
FIG. 6A to FIG. 6B are schematic diagrams illustrating the operation of the illuminating guidance system according to an embodiment of the invention.
Figure 6B:
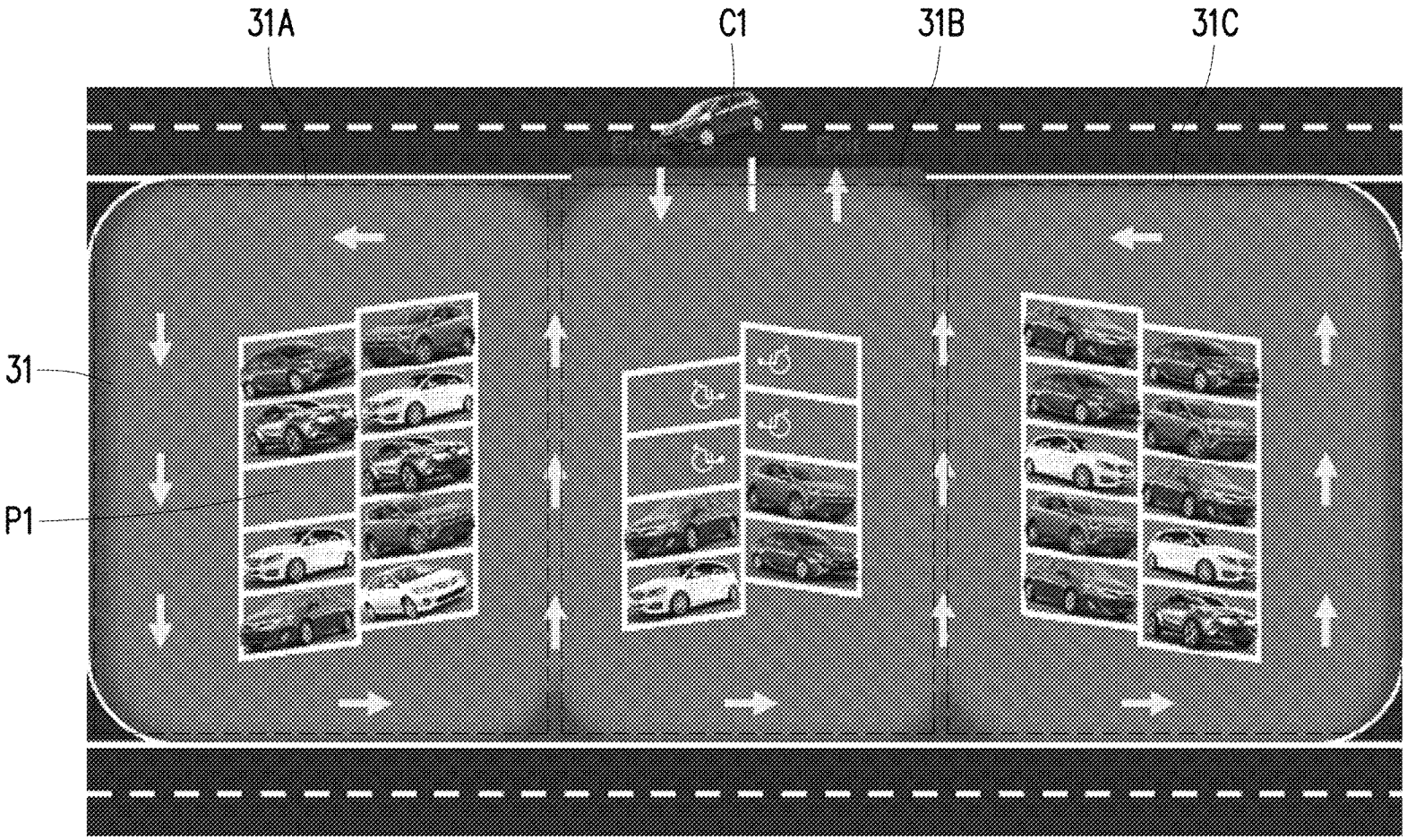

FIG. 6A to FIG. 6B are schematic diagrams illustrating the operation of the illuminating guidance system according to one embodiment of the invention. Referring to FIG. 6A, similar to the illuminating guidance system 1000 illustrated in FIG. 5, the illuminating guidance system 1000 illustrated in FIG. 6 includes three illuminating devices 100_1 to 100_3 having the same structure, and the illuminating devices 100_1 to 100_3 are equipped in the parking lot 31. When the LED light boards 40 to 44 of the illuminating devices 100_1 to 100_3 respectively project the light from the top to the ground of the parking lot 31, illumination areas 31A, 31B and 31C may be respectively generated in the parking lot 31, as illustrated in FIG. 6B. In addition, the LED light boards 40 to 44 of the illuminating devices 100_1 to 100_3 may jointly generate the guidance light pattern as illustrated in FIG. 3A to FIG. 3F. When the vehicle C1 illustrated in FIG. 6B enters into the parking lot 31, the vehicle C1 may be guided to the vacant parking space P1 according to the guidance light pattern provided by the LED light boards 40 to 44.

Figure 7A:
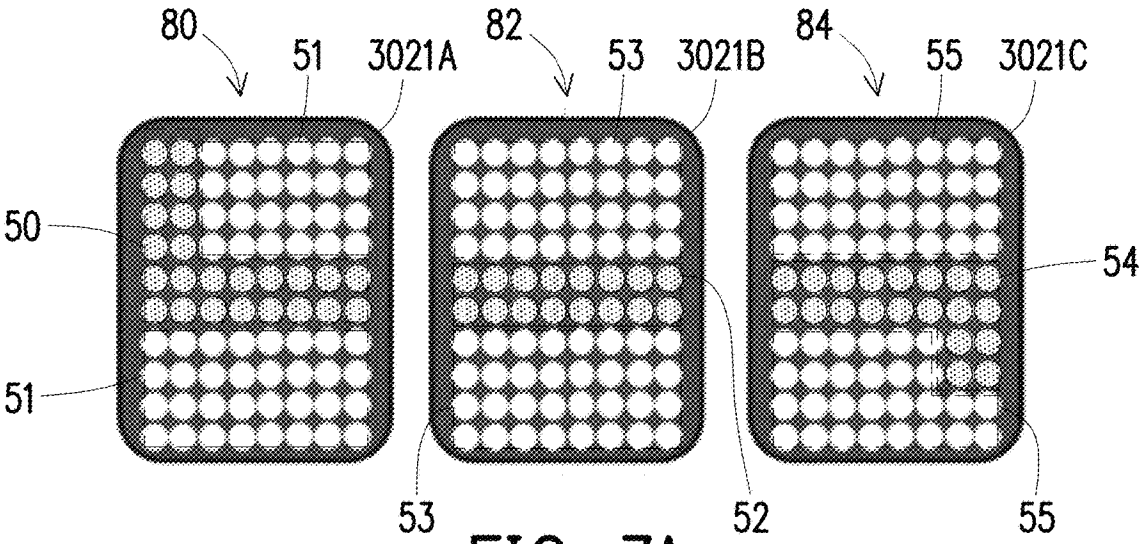
FIG. 7A to FIG. 7B are schematic diagrams illustrating synchronous guidance by using a plurality of LED light boards according to another embodiment of the invention.
Figure 7B:
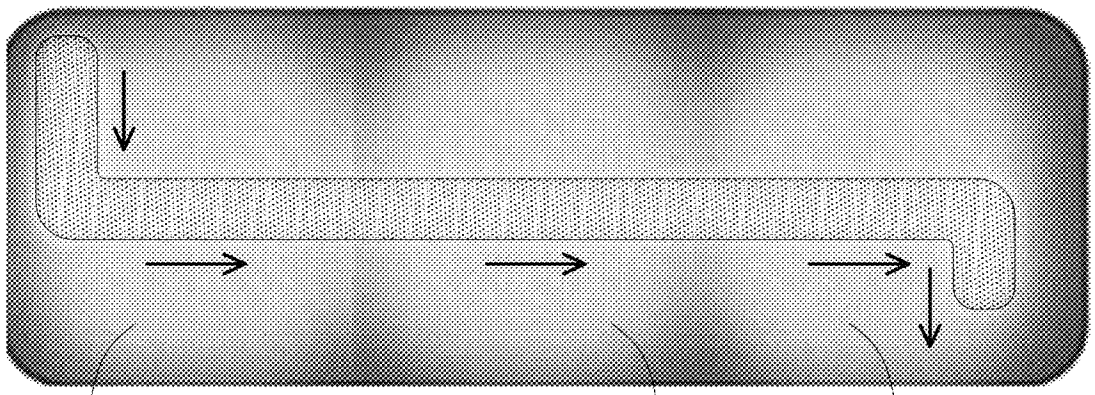

In addition, FIG. 7A to FIG. 7B are schematic diagrams illustrating synchronous guidance by using a plurality of LED light boards according to another embodiment of the invention. For descriptive convenience, FIG. 7A only illustrates a first LED light board 80, a second LED light board 82 and a third LED light board 84. It should be noted that the first LED light board 80, the second LED light board 82 and the third LED light board 84 respectively belong to three different illuminating devices, and the illuminating devices may communicate with one another through a wireless transmission protocol. However, the invention is not limited thereto. In other embodiments, the first LED light board 80, the second LED light board 82 and the third LED light board 84 may also together belong to the same illuminating device. In other words, one illuminating device may include the LED light board 80, the LED light board 82 and the LED light board 84. However, the number of the LED light boards included in one illuminating device is not limited in the invention. Referring to FIG. 7A, after a guidance path is determined by the controller, it is assumed that the guidance path includes illumination areas 41A, 41B and 41C of the first LED light board 80, the second LED light board 82 and the third LED light board 84. By controlling the first LED light board 80, a group of the light emitting diodes of the first LED light board 80 may be controlled to emit the guidance light 22 to generate a guidance light pattern 50, and another group of the light emitting diodes in the first LED light board 80 may be controlled to emit the illumination light 21 to generate an illumination light pattern 51. An illuminating guidance light pattern 3021A is constituted by the guidance light pattern 50 and the illumination light pattern 51. In addition, by controlling the second LED light board 82, a group of the light emitting diodes of the LED light board 82 may be controlled to emit the guidance light 22 to generate a guidance light pattern 52, and another group of light emitting diodes in the second LED light board 82 may be controlled to emit the illumination light 21 to generate an illumination light pattern 53. An illuminating guidance light pattern 3021B is constituted by the guidance light pattern 52 and the illumination light pattern 53. In addition, by controlling the third LED light board 84, a group of light emitting diodes of the third LED light board 84 may be controlled to emit the guidance light 22 to generate a guidance light pattern 54, and another group of light emitting diodes in the LED light board 44 is controlled to emit the illumination light 21 to generate an illumination light pattern 55. An illuminating guidance light pattern 3021C is constituted by the guidance light pattern 54 and the illumination light pattern 55.

Referring to FIG. 7B, the planned guidance path includes the illumination areas 41A, 41B and 41C, each of the first LED light board 80, the second LED light board 82 and the third LED light board 84 may also project the guidance path by the illuminating guidance light patterns 3201A to 3021C (as shown by the arrow in FIG. 7B). In this way, the driver may accurately find a target vacant parking space.

Specially, in an embodiment, when the vehicle moves forward along the guidance path, the controller of the illuminating device may adjust the guidance light patterns emitted by the light emitting diodes. For example, the guidance light 22 projected on the guidance path is sequentially switched to the illumination light when the vehicle is passing through the guidance location of the guidance path. In other word, the energy saving can be achieved by sequentially switching the light emitting diodes with the illumination light 21 instead of the guidance light 22.

In another embodiment, when the vehicle moves forward along the guidance path and does not arrive to the vacant parking space, the controller of the illuminating device may keep providing the guidance light 22 on the guiding path. When the vehicle is guided to the vacant parking space, the controller of the illuminating device may adjust the light emitting diodes with the illumination light 21 instead of the guidance light 22.

Additionally, in an embodiment, as illustrated in FIG. 3A to FIG. 3F above, the controller of the illuminating device may also control the light emitting diodes to project the guidance light 22 in front of the vehicle with a fixed distance (such as 100 m), thereby indicating a guiding direction of the guidance path and dynamically adjusting the guidance light pattern of the LED light board according to the moving of the vehicle.

Figure 8:
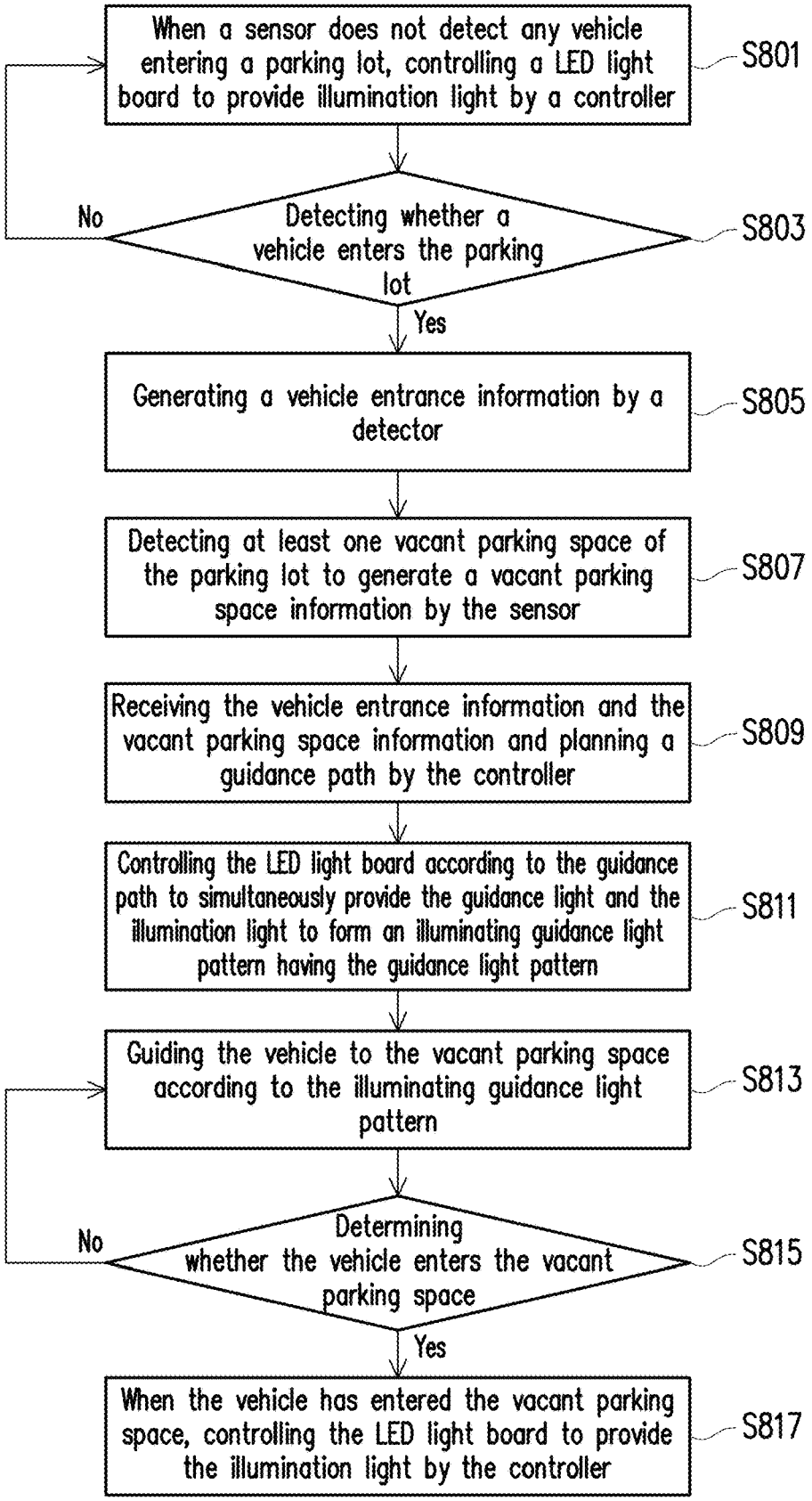
FIG. 8 is a flowchart illustrating an illuminating guidance method according to an embodiment of the invention.

FIG. 8 is a flowchart illustrating an illuminating guidance method according to an embodiment of the invention.

Referring to FIG. 8, the illuminating guidance method of the invention, when being applied to an indoor parking garage, includes steps as follows. In step S801, when the sensor 14 does not detect any vehicle entering a parking lot, the controller 10 controls the LED light board 16 to provide the illumination light 21. In step S803, the detector 12 detects whether a vehicle enters the parking lot. If no vehicle enters the parking lot, step S801 is performed. If a vehicle enters the parking lot, in step S805, the detector 12 generates a vehicle entrance information. Then, in step S807, the sensor 14 detects at least one vacant parking space of the parking lot to generate vacant parking space information. In step S809, the controller 10 receives the vehicle entrance information and the vacant parking space information and plans a guidance path. In step S811, the controller 10 controls the LED light board 16 according to the guidance path to simultaneously provide the guidance light and the illumination light to form an illuminating guidance light pattern having the illumination light pattern and the guidance light pattern. In step S813, the vehicle is guided to the vacant parking space according to the illuminating guidance light pattern. In step S815, the sensor 14 determines whether the vehicle enters the vacant parking space. If the vehicle does not yet enter the vacant parking space, step S813 is performed. If the vehicle has entered the vacant parking space, in step S817, the controller 10 controls the LED light board 16 to provide the illumination light 21. It should be noted that the illumination light may be omitted in the invention, and the main spirit of the invention lies in guiding the vehicle to the vacant parking space according to the guidance light pattern. For example, when the illuminating guidance system is applied in an outdoor parking lot and used in the daytime, the LED light board does not have to provide the illumination light, and when the detector detects that a vehicle enters the parking lot, the LED light board provides the guidance light, which also falls within the scope sought to protect by the invention.

Based on the above, in the exemplary embodiments of the invention, each of the illuminating devices of the illuminating guidance system is equipped with the detector, the sensor, the LED light board and the controller. The controller can plan the guidance path for guiding the vehicle to the vacant parking space according to the vacant parking space information provided by the sensor and the vehicle entrance information provided by the detector, while the controller can also correspondingly adjust the luminance intensity value of the light emitted diodes according to the guidance path, thereby indicating a part of or all of the guidance paths inside the parking lot to guide the vehicle to the vacant parking space. As the outdoor parking lot is usually equipped with the illuminating devices, the illuminating devices capable of guiding the vehicle may reduce the construction cost of the parking space guidance system, and decrease the searching time that the driver is searching for a vacant parking apace in the outdoor parking lot.

Although the present invention has been disclosed by the above embodiments, they are not intended to limit the present invention. Any person skilled in the art can make modifications and variations without departing from the spirit and scope of the present invention. Therefore, the protection scope of the present invention falls in the appended claims.

What is claimed is:

1. An illuminating device for guiding a vehicle in a parking lot, the illuminating device comprising:

a detector configured to detect the vehicle entering the parking lot to generate a vehicle entrance information;

a sensor configured to detect at least one vacant parking space of the parking lot to generate a vacant parking space information;

a LED light board having a plurality of light emitting diodes, each of the plurality of light emitting diode being provided with at least one of a guidance light and an illumination light, wherein the illumination light and the guidance light have different luminance intensity values, the plurality of light emitting diodes are arranged in an array so as to provide at least one of a guidance light pattern and an illumination light pattern, the guidance light pattern is at least formed by the guidance light emitted from the plurality of light emitting diodes, and the illumination light pattern is at least formed by the illumination light emitted from the plurality of light emitting diodes; and a controller coupled to the detector, the sensor and the LED light board, wherein the controller receives the vehicle entrance information, plans a guidance path according to the vacant parking space information, and controls the LED light board to provide the guidance light pattern indicating the guidance path, wherein the vehicle is guided to the vacant parking space according to the guidance light pattern.

2. The illuminating device according to claim 1, wherein when the sensor does not detect the vehicle entering the parking lot, the controller controls the LED light board to provide the illumination light.

3. The illuminating device according to claim 1, wherein when the sensor detects the vehicle entering the parking lot, the controller plans the guidance path according to the vacant parking space information, the LED light board simultaneously provides an illuminating guidance light pattern having the guidance light pattern, wherein the illuminating guidance light pattern is formed by the guidance light and the illumination light and the vehicle is guided to the vacant parking space according to the illuminating guidance light pattern.

4. The illuminating device according to claim 1, wherein the guidance path comprises a first guidance location and a second guidance location, and the detector further detects a location of the vehicle, wherein when the detector detects that the vehicle is leaving the first guidance location toward the second guidance location, the controller switches the guidance light projected on the first guidance location to the lamination light, and when the detector detects that the vehicle is leaving from the second guidance location, the controller switches the guidance light projected on the second guidance location to the lamination light.

5. The illuminating device according to claim 1, wherein the guidance path comprises a first guidance location and a second guidance location, and the detector further detects a location of the vehicle, wherein when the detector detects that the vehicle is located at the first guidance location, the controller controls the light-emitted diodes to provide the guidance light projected on the first guidance location, and when the detector detects that the vehicle is located at the second guidance location, the controller controls the light-emitted diodes to provide the guidance light projected on the second guidance location.

6. The illuminating device according to claim 1, wherein the guidance path comprises a first guidance location and a second guidance location, when the detector detects that the vehicle approaches the first guidance location, the controller controls the light-emitted diodes to provide the guidance light projected on the first guidance location, when the detector detects that the vehicle is leaving from the first guidance location, the controller switches the guidance light projected on the first guidance location to the illumination light, and when the detector detects that the vehicle approaches the second guidance location, the controller controls the light-emitted diodes to provide the guidance light projected on the second guidance location.

7. The illuminating device according to claim 1, wherein when the sensor detects that the vehicle enters the vacant parking space, the controller controls the LED light board to provide the illumination light.

8. The illuminating device according to claim 1, wherein the controller controls a part of the light emitting diodes of the LED light board to provide the guidance light, such that the LED light board provides the guidance light pattern.

9. The illuminating device according to claim 1, wherein the LED light board is formed of a dot-matrix display, the guidance light pattern is performed by the dot-matrix display.

10. An illuminating guidance system, suitable for guiding a vehicle in a parking lot, the illuminating guidance system comprising:

a first illuminating device, comprising:

a detector configured to detect the vehicle entering the parking lot to generate a vehicle entrance information;

a sensor configured to detect at least one vacant parking space of the parking lot to generate a vacant parking space information;

a first LED light board having a plurality of first light emitting diodes, each of the plurality of first light emitting diodes being provided with at least one of a guidance light and an illumination light, wherein the illumination light and the guidance light have different luminance intensity values, the plurality of first light emitting diodes are arranged in an array so as to provide at least one of a guidance light pattern and an illumination light pattern, the guidance light pattern is at least formed by the guidance light emitted from the plurality of first light emitting diodes, and the illumination light pattern is at least formed by the illumination light emitted from the plurality of first light emitting diodes; and a controller coupled to the detector, the sensor and the first LED light board, the controller receiving the vehicle entrance information, planning a guidance path according to the vacant parking space information and controlling the first LED light board to provide the guidance light patters indicating the guidance path, wherein the vehicle is guided to the vacant parking space according to the guidance light pattern; and a second illuminating device comprising a second LED light board, wherein the second illuminating device and the first illuminating device communicate with each other through a wireless protocol.

11. The illuminating guidance system according to claim 10, wherein the first LED light board of the first illuminating device and the second LED light board of the second illuminating device are provided with the guidance light and the illumination light in the parking lot.

12. An illuminating guidance method, suitable for a parking lot, the method comprising:

generating a vehicle entrance information when a detector detects a vehicle entering the parking lot;

generating a vacant parking space information when a sensor senses at least one vacant parking space of the parking lot;

providing at least one of a guidance light pattern and an illumination light pattern by a plurality of light emitting diodes arranged in an array, wherein the guidance light pattern is at least formed by the guidance light emitted from the plurality of light emitting diodes, and the illumination light pattern is at least formed by the illumination light emitted from the plurality of light emitting diodes;

receiving the vehicle entrance information and the vacant parking space information to plan a guidance path by a controller; and controlling a LED light board to provide the guidance light pattern indicating the guidance path by the controller, thereby guiding the vehicle to the vacant parking space according to the guidance light pattern.

* * * * *